United States Patent [19]

Lojovich

[11] Patent Number: 4,683,898

[45] Date of Patent: Aug. 4, 1987

[54] MANICURE FILE AND METHOD OF MAKING SAME

[76] Inventor: Obrey Lojovich, 455-14th Ave. South, South St. Paul, Minn. 55075

[21] Appl. No.: 813,938

[22] Filed: Dec. 27, 1985

[51] Int. Cl.[4] ..... A45D 29/04

[52] U.S. Cl. ..... 132/76.4; 132/73; 29/76 R; D28/59

[58] Field of Search ..... 132/76.4, 76.5, 73; D28/59, 56; 433/142; 168/48 R; 51/204, 394–397, 212; 29/76 R

[56] References Cited

U.S. PATENT DOCUMENTS

| | | | |
|---|---|---|---|
| 869,706 | 10/1907 | Hamilton | 132/76.4 |
| 893,004 | 7/1908 | Miller | 132/76.4 |
| 2,573,310 | 10/1951 | Collier | 132/76.4 |
| 3,318,318 | 5/1967 | Gewirz | 132/76.4 |
| 3,866,618 | 2/1975 | Tsukamoto | 132/76.4 |

*Primary Examiner*—Robert Peshock
*Assistant Examiner*—John G. Weiss
*Attorney, Agent, or Firm*—Henry C. Kovar

[57] ABSTRACT

A manicure file has a generally rectilinear shape and is made of sheet stock and has a holding section sized to be graspable between a thumb and finger, a first flange is formed up, a second flange is formed down, there is abrading medium on the flanges, and the file presents many different angles and configurations of abrading surface and is particularly well suited for preventing ingrown nails and nail damage. An alternative file is normally flat and has a flexural line extending across the file, the file will fold under pressure to present the abrading surfaces. A method of making these files has the steps of forming the flanges off of the holding sections, and constructing abrading medium on the flanges.

20 Claims, 10 Drawing Figures

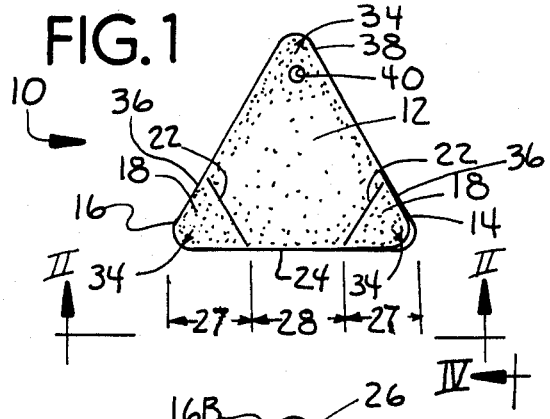
FIG. 1
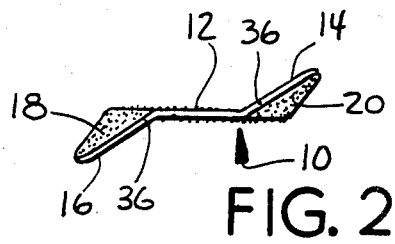
FIG. 2
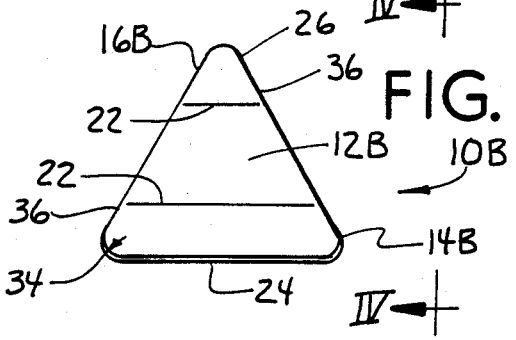
FIG. 3
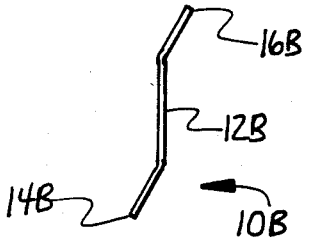
FIG. 4
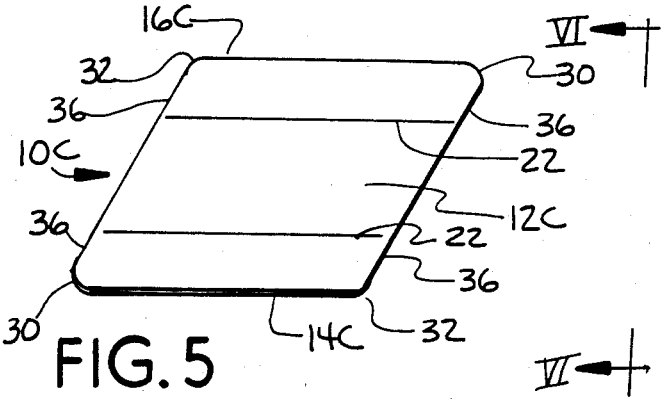
FIG. 5
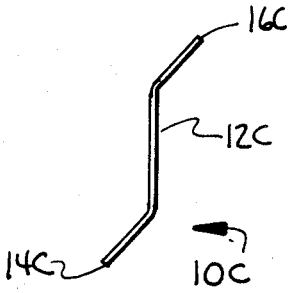
FIG. 6
FIG. 7
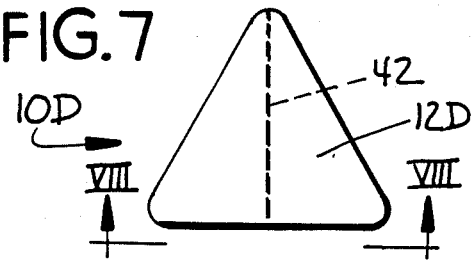
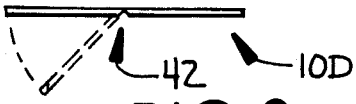
FIG. 8
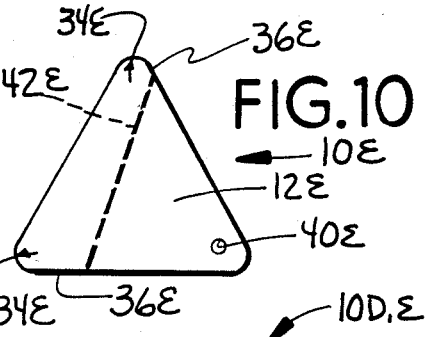
FIG. 10
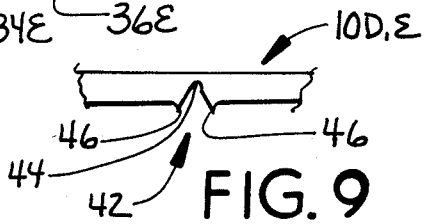
FIG. 9

MANICURE FILE AND METHOD OF MAKING SAME

BACKGROUND OF THE INVENTION

1. Field of the Invention

This invention pertains to a manicure file having structure for abrading removal of material, and to a method of making such a manicure file.

2. The Prior Art

Ingrown toenails, damaged toenails and fingernails, and damaged toes and fingers have been with humanity since day one. Accidental damage is responsible for most of these problems, lack of proper care for some, and some unfortunate people incur the wrath of a genetically caused defect.

Humans need to individually take care of their fingernails and toenails, young and old alike. There are two commonly available devices, the clipper and the elongate file board. Neither of these can do it all. The elongate nail board cannot easily be worked sideways and cannot effectively go into the corner of a nail, particularily the toenails. Clippers tend to leave jagged edges and sharp spikes on the outer edges of toenails, and these tend to cause ingrown toenails. The remedies for ingrown toenails are just plain nasty for anyone and everyone. Proper removal of sharp edges and proper removal of fold over along the top of a nail will help prevent ingrown nails and other undesirable events to adjacent nails. Proper rounding and burr removal helps reduce nail cracking and splitting and is of particular interest to women.

Most pets, such as dogs and cats, also need to have their claws trimmed and deburred, and there is a lack of implements for this purpose.

OBJECTS OF THE INVENTION

It is an object of the present invention to provide a new and improved manicure file that is easy to manipulate by young and old, and which is very effective to use while remaining inexpensive.

It is an object of the present invention to provide for better nail care and decrease the occurance of ingrown nails and damaged nails.

It is an object of the present invention to provide a new nail file that can easily do a better job of taking care of the corners of toenails and fingernails.

It is an object of the present invention to provide a new and improved nail file that is of such economical construction and small size that it can be made available to the mass of humanity and easily carried and used.

It is an object of the present invention to provide a new method of making an improved nail file.

These and other objects and advantages of the invention will become manifest to those versed in the art upon review of the disclosure and teachings thereinafter following.

SUMMARY OF THE INVENTION

According to the principles of the present invention, a manicure file has a contiguous and generally rectilinear sheet with a holding section sized to be graspable between the thumb and an adjacent finger, a first flange obtusely folded from the holding section, a second flange discretely obtusely folded from the holding section, and abrading medium on a first surface of each flange, the abrading medium being on the same side of the file.

A method of making a manicure file has the steps of forming a sheet into a contiguous and generally rectilinear shape, forming a first flange of minor area, forming a second flange of minor area, leaving a planar holding section in between the flanges with the holding section having a greater area than both of the flanges, and constructing abrading medium on the same side of both flanges.

A manicure file for abrading removal of material has a rectilinear shaped planar sheet, structure on one side for abrading removal of material, a flexural joint on a second side of the sheet, structure for limiting sheet folding in the joint to an obtuse angle with abrading medium being on the convex side of the folded file, and at least one of the sections to one side of the flexural joint being configured to be graspable between a thumb and an adjacent finger of a user.

These and other objects, advantages and features of the present invention will become apparent to those versed in the art after consideration of the following detailed description and the drawing a part hereof.

BRIEF DESCRIPTION OF THE DRAWINGS:

FIG. 1 is a plan view of a preferred embodiment of the manicure file of the present invention;

FIG. 2 is an elevational view of the structure of FIG. 1 taken through lines II—II;

FIG. 3 is a plan view of an alternative preferred embodiment of the manicure file of the present invention;

FIG. 4 is an elevational view of the structure of FIG. 3 taken through lines IV—IV;

FIG. 5 is a plan view of a further alternative preferred embodiment of the present invention;

FIG. 6 is an elevational view of the structure of FIG. 5 taken through lines VI—VI;

FIG. 7 is a plan view of a further preferred alternative embodiment of the present invention;

FIG. 8 is an elevational view of the structure of FIG. 7 taken through lines VIII—VIII;

FIG. 9 is a detailed elevational view of the flexural joint from FIG. 8; and FIG. 10 is a plan view of a further preferred alternative embodiment of the present invention.

DESCRIPTION OF THE PREFERRED EMBODIMENT

According to the principles of the present invention a manicure file such as shown in FIG. 1 and such as is generally indicated by the numeral 10, has a contiguous and generally rectilinear form as shown with one of the preferred shapes being generally triangular as specifically shown in FIGS. 1-4, 7 and 10. The file 10 has a structural body made of a planar sheet having a thickness of about 0.03 inches (0.75 mm). A preferred material is a thermoplastic, and a second preferred material is aluminum; both of these materials being relatively rigid in the preferred thickness and size of the file 10 and under the structural loadings applied thereon by a human hand. The file 10 has a central main holding section 12 sized to be graspable between the thumb and an adjacent finger of an adult user.

A first flange 14 is formed upwardly and is obtuse with respect to the holding section 12. A second flange 16 is formed downwardly and is obtuse with respect to the holding section 12. The upper surface 18 of each flange 14, 16 has an abrading medium surface, the abrading medium can be a frictional abrasive paper secured to the file 10, cut teeth if a metal sheet is utilized or a sprayed and deposited adhesive and grit. The abrading medium is one of the currently used mediums and is applied by currently known technique. Preferrably the bottom surface 20 of each flange 14, 16 also has a similar abrading medium, but likely of different grit.

The triangular shape of the file 10 as shown in FIGS. 1–4, 7 and 10 is preferrably equilateral and each flange 14, 16 as shown specifically in FIGS. 1 & 2, is preferrably equilateral with the fold lines 22 being about sixty degrees to each other and as measured on a base side 24 the length 27 of the flanges 14, 16 are generally equal to the minimum spacing 28 between bend lines 22. The preferred true angle between the holding section 12 and each of the flanges 14, 16 is in the range of 15 to 60 degrees and the specific preferred angles are 30 and 45 degrees. The obtuse included angle between the holding section 12 and each of the flanges is in the range of 120 to 175 degrees and preferred obtuse angles are 135 and 160 degrees.

In the embodiment of FIGS. 3 & 4, the shape and size of the trianglar file 10B is essentially identical to the file 10 of FIGS. 1 & 2. However, this file 10B has an upwardly formed first flange 14B along its base edge 24 and a downward formed flange 16B on its opposite or third apex 26. Again the holding section 12B is in the center of the file 10B, with both apexes adjacent to the base edge 24 being in the wide flange 14B.

In the embodiment of FIGS. 5 & 6, the file 10C is in the form of a quadrilateral as is shown clearly in FIG. 5, and preferrably is in the form of a general parallelogram having equal length opposed sides and a pair of opposed acute angled apexes 30 and a pair of opposed obtuse angle apexes 32. The first flange 14C is generally parallel to and along an edge and is formed upward and, the second flange 16C is generally parallel to and along an edge on an opposite side of the file 10C and is formed downward. The flanges 14C, 16C are full width along their respective edges and all of the apexes 30, 32 are in the flanges 14C, 16C.

In each of these embodiments 10, 10B, 10C as shown in FIGS. 1–6, the corner apexes have a radius 34, with a convex outward facing profile. In every instance the fold line 22 is spaced inward from the corner apex a distance greater than the length of the radius 34 so that there is always a straight edge, or flat, 36 extending tangentially from the apex radius 34 to the fold line 22. In each embodiment the holding section 12, 12B, 12C has an area that is larger than the combined areas of the respective flanges 14 & 16, 14B & 16B, 14C & 16C. It is also preferrable that some type of high friction surface be provided on the holding sections 12, 12B, 12C and for this purpose the abrading medium is preferrably extended to both sides of the holding sections 12, 12B, 12C, and preferrably both sides of the file 10, 10B, 10C are completely covered with abrading medium.

As shown in FIG. 1, the apex which is not formed 38, is co-planar with the holding section 12 and has a suspension aperture 40 spaced inward from the edge for hanging the file 10 on a keychain or the like (not shown). The flat and unformed apex 38 also has the abrading medium on it, preferrably on both sides.

The preferred alternative embodiments of FIGS. 7–10 are manicure files 10D and 10E which are normally flat and do not have the folded flanges 14, 16 of the files 10, 10B, 10C of FIGS. 1–6. The alternative files 10D, 10E are normally flat but can be selectively folded over and will resiliently return to the flat form. Both sides of these files 10D, 10E have abrading medium, and one of the sides has a flexural joint 42 which extends completely across the file 10D, 10E. The flexural joint 42 is shown in detailed cross-section in FIG. 9 and is a molded or pressed hinge joint with a thin hinge section 44 and a pair of abutting stops 46 which limit folding of the file 10D, 10E so that one section can fold in the range of 15 to 60 degrees with respect to the other section to form an obtuse included angle in the range of 120 to 175 degrees; a preferred obtuse included angle is in the range of 135 to 160 degrees. A preferred core material of the files 10D, 10E is a thermoplastic, and the flexural joint 42 is preferrably a living hinge type device. There is always abrading medium on the convex side of the file 10D, 10E. At least one of the sections 12D, 12E on one side of the flexural joint is sized to be manually graspable between the thumb and a finger. In the embodiment in FIG. 10, the flexural line 42E is positioned asymetrically alongside but not parallel to one of the edges of the file 10E. The flexural line 42E extends completely across the file 10E and the larger section 12E is the holding section. In the embodiment of FIG. 7, either side of the flexural line 42 can be used as the holding section 12D. The flexural line 42E is positioned so that both adjacent apex radii 34E are beyond and spaced from the line 42E so that there is a small straight edge 36E between each radii 34E and the line 42E. A suspension aperture 40E may be in the holding section 12E.

The files 10, 10B, 10C as well as 10D and 10E are extremely economical and easy to manufacture and the costs can be quite effective.

In the use of the files 10, 10B, 10C, the user grasps the holding sections 12, 12B, 12C and can manipulate one or more of the medium covered flanges 14, 14B, 14C, 16, 16B, 16C or the flat apex 38 in, about, under, over, around, inside of all accessible edges of a toenail or fingernail. The files are extremely effective in caring for the nails to prevent ingrown toenails. The files 10D, 10E are likewise grasped, and under pressure against a work surface, the sections will fold over against each other. Regardless of which of the files 10, 10B, 10C, 10D, 10E are used, there is some type of lateral surface against which the thumb and finger abut so that these new files can be much better manipulated and used, and therefore be much more effective. The files 10, 10B, 10C, 10D, 10E present many different angles and forms of abrading medium adjacent the nails.

Although other advantages may be found and realized and various modifications may be suggested by those versed in the art, it should be understood that I wish to embody within the scope of the patent warranted hereon, all such embodiments as reasonably and properly come within the scope of my contribution to the art.

I claim as my invention:

1. A manicuring file for abrading removal of material comprising:

(a) a contiguous and integral sheet with a perimeter having a plurality of generally straight edges and having (1) a centrally located main holding section sized to be graspable between an adult humans thumb and an adjacent finger, said holding section being planar and lying in a first plane, (2) a first flange obtusely folded across a first fold line between the holding section and the perimeter, said first flange being fixed with respect to the holding section in a second plane which is discrete from said first plane, and (3) a second flange spaced from said discrete from the first flange, said second flange being obtusely folded across a second fold line between the holding section and the perimeter, said second flange being fixed with respect to the holding section in a third plane which is discrete from either of said first or second planes; and (b) abrading medium on a first surface of each of the flanges, said first surfaces and medium being on the same side of the file.

2. The file of claim 1 in which the first flange is folded relatively up with respect to the holding section, and the second flange is folded relatively down.

3. The file of claim 1, in which each flange is permanently folded and fixed in the range of 15–60 degrees from the plane of the holding section.

4. The file of claim 1, including a rounded apex in each folded and fixed flange, each such respective apex being the intersection of sides of the file and each such apex having a radius which is shorter than a depth of the flange as measured from the radius apex to the respective fold line, each flange having a straight edge on each side of its apex radius.

5. The file of claim 1, including a second abrading medium on a second surface of each of the flanges, said second surfaces and second medium being opposite the first said flange surfaces.

6. The file of claim 1, in which the sheet has a plastic core and frictional abrading medium.

7. The file of claim 1, in which the file is generally triangular shaped with at least two apexes of the generally triangular shape being in said folded and fixed first and second flanges.

8. The file of claim 7, in which the file is generally equilateral, in which each of the flanges is equa-sided, and in which a third apex is flat and co-planar with the holding section.

9. The file of claim 8, in which the holding section includes about one-third of an edge extending in and directly between the flanges.

10. The file of claim 8, including a suspension aperture just inward of the third apex.

11. The file of claim 8, in which the flanges have fold lines converging at about sixty degrees.

12. The file of claim 7, in which the first flange is along and includes a base of the triangle with the first flange fold line being generally parallel to said base, and in which the second flange has a fold line spaced from and generally parallel to the first flange fold line. The first flange including two base apexes and the second flange including the third apex.

13. The file of claim 1, in which the file is a generally quadrilateral and the flanges are on opposite sides of the quadrilateral.

14. The file of claim 13, in which the file is generally in the shape of a parallelogram.

15. The file of claim 13, in which the file has a pair of opposed obtuse apexes, a pair of opposed acute apexes, and a radius forming each apex with each radius being entirely within a respective flange.

16. The file of claim 13, in which the first flange is folded up and the second flange is folded down.

17. A method of making a manicuring file, comprising the steps of:

(a) forming a sheet into a contiguous and generally rectilinear shape;

(b) forming a first flange by obtusely folding a minority of the area of the shape upwardly;

(c) forming a second flange by obtusely folding a second minority of the area of the shape downwardly;

(d) leaving a planar holding section in between the flanges, the holding section having an area greater than both of the flanges; and (e) constructing abrading medium on the same side of each of the flanges.

18. A manicuring file for abrading removal of human toenail or fingernail material, comprising:

(a) a rectilinear shaped structurally integral planar sheet;

(b) abrading medium on a first side of the sheet for abrading removal of material;

(c) a flexural living hinge joint on a second side of the sheet and across the sheet for easy and resilient folding of the sheet with the abrading means being on the convex side when folded;

(d) means associated with said flexural joint for limiting the sheet folding in the joint to an obtuse angle; and in which (e) at least one section to a side of the flexural joint is configured to be a holding section graspable between a thumb and an adjacent finger of a user.

19. The file of claim 18, in which the flexural living hinge joint is asymetric across the rectilinear shaped sheet.

20. The file of claim 19, in which the file is triangular shaped and has convexly radiused apexes, said flexural living hinge joint being adjacent but not parallel to one of the sides of the triangular shape, both apexes adjacent to said flexural living hinge joint being totally off to one side of the flexural hinge joint.

* * * * *